US011384715B2

(12) United States Patent
Servatius et al.

(10) Patent No.: US 11,384,715 B2
(45) Date of Patent: Jul. 12, 2022

(54) MIXTURE FORMATION UNIT AND TWO STROKE ENGINE HAVING A MIXTURE FORMATION UNIT

(71) Applicant: Andreas Stihl AG & Co. KG, Waiblingen (DE)

(72) Inventors: Felix Servatius, Remshalden (DE); Wolfgang Luithardt, Waiblingen (DE); Horst Denner, Weinstadt (DE); Martin Christoph Arenz, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/894,383

(22) Filed: Jun. 5, 2020

(65) Prior Publication Data

US 2020/0386192 A1 Dec. 10, 2020

(30) Foreign Application Priority Data

Jun. 8, 2019 (DE) ..... 102019004063.5

(51) Int. Cl.

| | |
|---|---|
| ***F02M 17/36*** | (2006.01) |
| ***F02B 25/04*** | (2006.01) |
| ***F02B 75/02*** | (2006.01) |
| ***F02B 77/04*** | (2006.01) |
| ***F02D 9/10*** | (2006.01) |
| ***F02M 7/12*** | (2006.01) |

(Continued)

(52) U.S. Cl.

CPC ..... *F02M 17/36* (2013.01); *F02B 25/04* (2013.01); *F02B 75/02* (2013.01); *F02B 77/04* (2013.01); *F02D 9/109* (2013.01); *F02M 7/12* (2013.01); *F02M 29/00* (2013.01); *F02M 35/10216* (2013.01); *F02M 35/10262* (2013.01); *F02B 2075/025* (2013.01)

(58) Field of Classification Search

CPC ..... F02M 17/36; F02M 7/12; F02M 29/00; F02M 35/10216; F02M 35/10262; F02B 25/04; F02B 75/02; F02B 77/04; F02B 2075/025; F02B 33/04; F02D 9/109

See application file for complete search history.

(56) References Cited

U.S. PATENT DOCUMENTS

| | | | | |
|---|---|---|---|---|
| 1,061,835 A | | 5/1913 | Gobbi | |
| 2,408,726 A | * | 10/1946 | Bicknell | F02M 17/36 261/72.1 |

(Continued)

FOREIGN PATENT DOCUMENTS

| | | |
|---|---|---|
| DE | 101 56 353 A1 | 5/2002 |
| EP | 3115572 A1 | 1/2017 |
| GB | 1498777 A | 1/1978 |

*Primary Examiner* — Syed O Hasan
(74) *Attorney, Agent, or Firm* — Walter Ottesen, P.A.

(57) ABSTRACT

A mixture formation unit has a base body in which an intake channel section is formed. The intake channel section extends from a first end side of the base body to a second end side of the base body. The mixture formation unit has at least one rectilinearly extending channel which opens into the intake channel section. The channel opens at the first end side of the base body. The mixture formation unit is preferably provided for a two stroke engine whose intake channel is divided downstream of the mixture formation unit into a mixture channel and an air channel.

18 Claims, 3 Drawing Sheets

(51) Int. Cl.
*F02M 29/00* (2006.01)
*F02M 35/10* (2006.01)

(56) References Cited

U.S. PATENT DOCUMENTS

| | | | | |
|---|---|---|---|---|
| 4,276,239 | A * | 6/1981 | Yoshikawa | F02M 17/09 261/DIG. 38 |
| 5,133,905 | A | 7/1992 | Woody et al. | |
| 5,560,345 | A * | 10/1996 | Geyer | B27B 17/00 123/516 |
| 6,672,570 | B2 | 1/2004 | Takano et al. | |
| 7,201,120 | B2 | 4/2007 | Geyer et al. | |
| 2005/0073062 | A1* | 4/2005 | Zwimpfer | F02M 19/00 261/65 |
| 2014/0261329 | A1* | 9/2014 | Braun | F02M 17/04 123/446 |
| 2015/0337765 | A1* | 11/2015 | Yamazaki | F02M 19/08 123/73 A |
| 2016/0153346 | A1* | 6/2016 | Ohsawa | F02M 35/10196 123/586 |
| 2016/0376979 | A1 | 12/2016 | Osawa et al. | |
| 2017/0058788 | A1* | 3/2017 | Tobinai | F02M 1/02 |

* cited by examiner

MIXTURE FORMATION UNIT AND TWO STROKE ENGINE HAVING A MIXTURE FORMATION UNIT

CROSS REFERENCE TO RELATED APPLICATION

This application claims priority of German patent application no. 10 2019 004 063.5, filed Jun. 8, 2019, the entire content of which is incorporated herein by reference.

FIELD OF THE DISCLOSURE

The invention relates to a mixture formation unit and to a two stroke engine having a mixture formation unit.

BACKGROUND OF THE DISCLOSURE

US 2014/0261329 A1 discloses a mixture formation unit, namely a carburetor in which the main fuel nozzle is arranged in a rectilinear channel. As a result, the main fuel nozzle can be pushed or pressed from outside into the base body of the carburetor in a simple manner. On the base body there are arranged a cover, which holds the control membrane, and also a cover of the fuel pump. If the cover, which holds the control membrane is mounted on the base body, the channel in which the main fuel nozzle is arranged is only accessible from the intake channel.

The channels of a carburetor are customarily at least partially produced using machining production methods. However, after mounting the cover of the regulating chamber, the channel in which the main fuel nozzle is arranged is accessible only from the intake channel. Therefore, cleaning of the carburetor after the assembly of all components is possible only to a limited degree. Particles which are situated in the fuel-conducting channels can become detached during operation and accumulate at undesired positions, for example at sensitive components such as valves or the like and thus interfere with the operation of the carburetor.

SUMMARY OF THE DISCLOSURE

It is an object of the invention to provide a mixture formation unit that has a high degree of robustness in operation and can be readily cleaned.

It is a further object of the invention to provide a two stroke engine having a mixture formation unit.

With regard to the mixture formation unit, this object can, for example, be achieved by a mixture formation unit having: a base body in which an intake channel section is formed; the base body having a first end side and a second end side; the intake channel section extending from the first end side of the base body to the second end side of the base body; at least one rectilinearly extending channel which opens into the intake channel section; and, wherein the at least one rectilinearly extending channel opens at the first end side of the base body.

With regard to the two stroke engine, the object can, for example, be achieved by a two stroke engine having: an intake channel having an intake channel section; a mixture formation unit having a base body in which the intake channel section is formed; the base body having a first end side and a second end side; the intake channel section extending from the first end side of the base body to the second end side of the base body; the mixture formation unit having at least one rectilinearly extending channel which opens into the intake channel section; the at least one rectilinearly extending channel opening at the first end side of the base body; a cylinder having a combustion chamber formed therein; a crankcase defining a crankcase interior; a crankshaft mounted in the crankcase; a piston configured to drive the crankshaft; the combustion chamber being delimited by the piston; the crankcase interior being connected in at least one position of the piston to the combustion chamber via at least one transfer channel; the intake channel being divided by a partition wall downstream of the intake channel section; and, the partition wall dividing the intake channel into a mixture channel for supplying a fuel/air mixture into the combustion chamber and into an air channel for supplying scavenging advance air to the at least one transfer channel.

There is provision that the channel which opens into the intake channel is configured as a rectilinearly extending channel and opens at an end side of the base body of the mixture formation unit. As a result, both ends of the channel are also still readily accessible after mounting add-on parts such as covers, a fuel pump or the control device of the mixture formation unit. Consequently, the channel can be completely cleaned and flushed through. A cleaning line can be connected in particular to the end side of the base body, resulting in good accessibility of the connection.

A component of the mixture formation unit can preferably be arranged in the channel. By virtue of the arrangement of the mouth opening of the channel at the first end side of the base body, the channel can be cleaned in a simple manner before mounting the component. In the event of functional disturbances, for example, the component arranged in the channel can subsequently be changed in a simple manner. Here, the first end side on which the channel opens can be both the upstream end side of the mixture formation unit and the downstream end side of the mixture formation unit. Advantageously, the mixture formation unit has at least one fuel opening which opens into the intake channel section and which is formed on a fuel nozzle. Here, fuel nozzle designates the component on which there is configured the constriction which forms the nozzle cross section. It is also possible for further functions to be realized in the fuel nozzle. The fuel nozzle is a component which can include a plurality of individual parts. The fuel opening can preferably be a main fuel opening and the fuel nozzle is a main fuel nozzle. Preferably, the component forms with the channel, in particular with the channel wall of the channel, an annular gap which is connected to the fuel opening. By virtue of the fact that the channel is configured as a rectilinear channel, it can be manufactured with a high degree of accuracy, for example by drilling or milling, thus resulting in defined dimensions for the annular gap.

The component arranged in the channel preferably has a check valve. Particles such as chips or the like which arise during the production and cannot be removed from the base body of the mixture formation unit can impair the sealing function of a valve plate of the check valve and thus considerably compromise the functioning. In particular for a check valve, it is therefore desirable to clean residues resulting from preceding machining methods, such as chips or the like.

In an alternative configuration, there is provision that the component is a fuel valve. The fuel valve preferably can have a valve plate which is movable between a stop and a valve seat. Here, too, chips or the like can adversely affect the sealing function of the valve plate. The fuel valve is in particular an electrically operated fuel valve, preferably an electromagnetic valve.

In an embodiment, the channel extends comparatively flat in the base body of the mixture formation unit. This results in an advantageous arrangement and good utilization of the customary available installation space in the mixture formation unit. The center axis of the channel advantageously encloses an angle of 0° to 30°, in particular from 0° to 25°, with the intake channel longitudinal axis in a section plane which contains the intake channel longitudinal axis and extends parallel to the center axis of the channel. The center axis of the channel can accordingly lie in one plane with the intake channel longitudinal axis or extend obliquely to the intake channel longitudinal axis. If the center axis of the channel extends obliquely to the intake channel longitudinal axis, the angle is measured in the section plane between a projection of the center axis of the channel perpendicular to the section plane and the intake channel longitudinal axis.

The intake channel section preferably has a venturi section. In particular a throttle element is mounted in the base body downstream of the venturi section. The throttle element is preferably arranged so as to be adjustable and serves for setting the free flow cross section of the intake channel section. The throttle element can advantageously be pivotable about a rotational axis.

The mixture formation unit is in particular a carburetor in which the fuel preparation occurs at least partially in the venturi section or downstream thereof. The first end side at which the channel opens is preferably the upstream end side of the base body. However, there can also be provision that the first end side at which the channel opens is the downstream end side of the base body. The throttle element is preferably a throttle flap. A choke element can advantageously be held in the base body upstream of the throttle element. The choke element is preferably a choke flap. With the choke element configured as a choke flap, there is sufficient installation space present in the installation channel section, with the result that the channel and the choke element can be arranged at least partially in the same cross section of the mixture formation unit. There can be provision that no partition wall section is arranged in the intake channel section upstream of the throttle element. In a preferred configuration, a partition wall section is arranged in the intake channel section upstream of the throttle element. A simple construction results if the component is pressed into the channel. Here, the component can be pressed directly into the channel. The outside circumference of the component and the channel may advantageously form an interference fit assembly and bear against one another. In an alternative configuration, there can be provision that the component is pressed into the channel with interposition of at least one seal. A plurality of seals can be advantageous, in particular in order to seal different regions on the outer circumference of the component with respect to one another. If the component has a valve, it can be particularly advantageous for the regions downstream and upstream of the valve to be separated from one another via at least one seal on the outer circumference of the component. The seal can be an O-ring, for example. However, another configuration of the seal can also be advantageous.

For a two stroke engine having a mixture formation unit, there is provision that the two stroke engine has a cylinder in which there is formed a combustion chamber which is delimited by a piston. The piston drives a crankshaft which is mounted so as to be rotatable in a crankcase. A crankcase interior is connected in at least one position of the piston to the combustion chamber via at least one transfer channel. The two stroke engine has an intake channel which, downstream of the intake channel section formed in the mixture formation unit, is divided by a partition wall into a mixture channel for the supply of fuel/air mixture into the combustion chamber and into an air channel for the supply of scavenging advance air to the at least one transfer channel. It has been shown that, in particular in a mixture formation unit for a stratified scavenging engine in which the intake channel section is divided into a mixture channel and an air channel, sufficient installation space is available for the rectilinear channel opening at an end side of the base body.

Upstream of the throttle element, there can be provided a partition wall section for subdividing the intake channel section into the mixture channel and the air channel. However, there can also be provision that no partition wall section for subdividing the intake channel section into the mixture channel and air channel is provided upstream of the throttle element.

The mixture formation device according to the disclosure can also be provided for a two stroke engine which does not have an air channel or for a two stroke engine which has an air channel routed separately from the mixture channel. The mixture formation device is also advantageous for a four stroke engine, in particular for a mixture-lubricated four stroke engine.

BRIEF DESCRIPTION OF THE DRAWINGS

The invention will now be described with reference to the drawings wherein.

DESCRIPTION OF THE PREFERRED EMBODIMENTS

Figure 1:
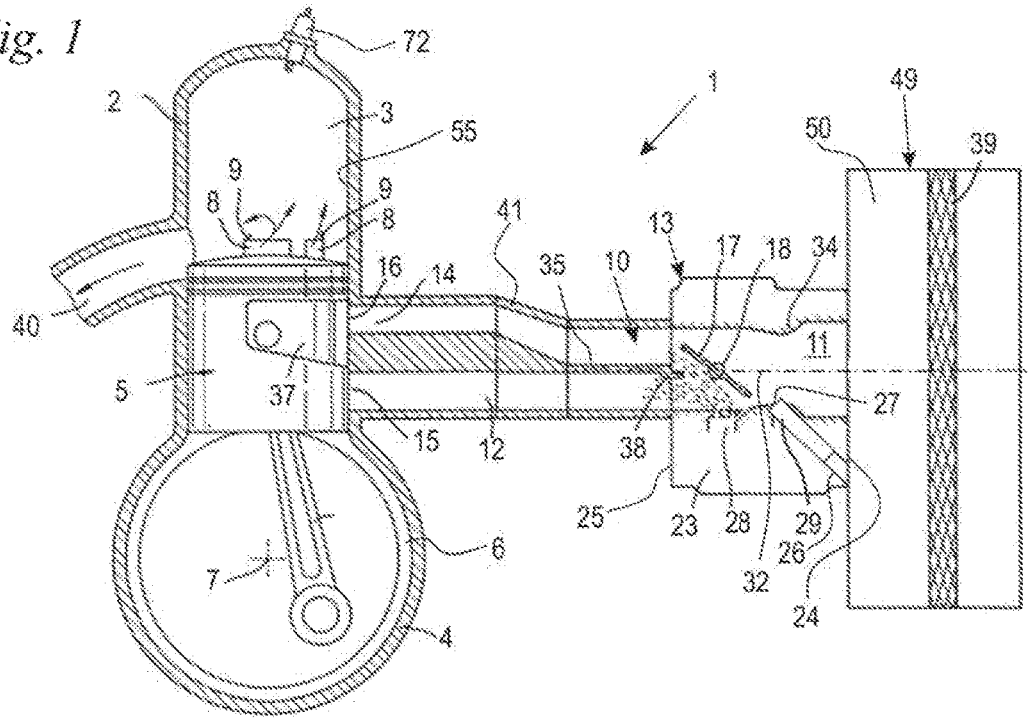
FIG. 1 shows a schematic illustration of a two stroke engine.

The two stroke engine 1 schematically illustrated in FIG. 1 has a cylinder 2 and a crankcase 4. A combustion chamber 3 is formed in the cylinder 2, and a crankcase interior 6 is formed in the crankcase 4. The crankcase interior 6 and the combustion chamber 3 are separated by a piston 5 which is movable back and forth in the cylinder 2. The crankcase interior 6 and the combustion chamber 3 are connected to one another via transfer channels 8 in predetermined piston positions, for example in the position of the piston 5 in the region of bottom dead center illustrated in FIG. 1. The transfer channels 8 open with transfer windows 9 into the combustion chamber 3. The transfer windows 9 are opened or closed in dependence on the position of the piston 5 with respect to the combustion chamber 3. The piston 5 drives in rotation a crankshaft 7 mounted rotatably in the crankcase 4. The two stroke engine 1 can be for example the drive engine in a handheld work apparatus such as a power saw, a cut-off grinder, a blowing apparatus, a hedge trimmer, a spraying apparatus or the like, and the crankshaft 7 can serve to drive a tool of the work apparatus. In the case of a blowing apparatus or spraying apparatus, the tool is typically a fan which delivers an operating air flow. Instead of a two stroke engine 1, the drive engine can also be a four stroke engine, in particular a mixture-lubricated four stroke engine.

The two stroke engine 1 has an intake tract with an air filter 49, a mixture formation unit 13 and a connecting piece 41 for connecting the mixture formation unit 13 to the cylinder 2. In the exemplary embodiment, the mixture formation unit 13 is a carburetor. Instead of the connecting piece 41, it is possible to provide one or more arbitrary other parts for fluidic connection of mixture formation unit 13 with the cylinder 2 or the crankcase 4. The air filter 49 has a filter element 39. Downstream of the filter element 39 there is formed a clean space 50 from which an intake channel 10 leads. An intake channel section 11 is formed in the mixture formation unit 13. A throttle element 17, in the exemplary embodiment a throttle flap, is mounted in an adjustable manner in the intake channel section 11. In the exemplary embodiment, the throttle element 17 is mounted with a throttle shaft 18. Downstream of the throttle element 17, the intake channel 10 is divided into a mixture channel 12 and an air channel 14. The intake channel 10 has an intake channel longitudinal axis 32 which forms the longitudinal center axis of the intake channel 10. The mixture channel 12 opens with a mixture channel opening 15 at the cylinder bore 55. The mixture channel opening 15 is controlled by the piston 5. The mixture channel opening 15 is opened toward the crankcase interior 6 in the region of top dead center of the piston 15. The air channel 14 opens with at least one air channel opening 16 at the cylinder bore 55. The air channel opening 16 is also controlled by the piston 5. The piston 5 has at least one piston pocket 37 which connects the air channel opening 16 to the transfer windows 9 in the region of top dead center of the piston 5. Via the air channel 14, the air channel opening 16 and the transfer windows 9, scavenging advance air is provided upstream in the transfer channels 8 in the region of top dead center of the piston 5. The cylinder 2 has an outlet 40 from the combustion chamber 3.

As FIG. 1 also shows, a main fuel opening 27 and a plurality of secondary fuel openings 28 open into the intake channel section 11 in the mixture formation unit 13. The main fuel opening 27 is formed on a main fuel nozzle 29. The main fuel opening 27 opens into the intake channel section 11 in the region of a venturi section 34. The mixture formation unit 13 has a base body 23 which has a first, upstream end side 24 and a second, downstream end side 25. The main fuel nozzle 29 is arranged in a rectilinear channel 26 which extends from the first end side 24 into the intake channel section 11. It is thus possible, during the production of the mixture formation unit 13 or after an exchange of the main fuel nozzle 29, for a hose with cleaning fluid, such as for example air, to be connected to the first end side 24, and the channel 26 and parts of the fuel system can be cleaned. An opening on the first end side 24 can also be advantageous for other channels of the mixture formation unit 13. In the exemplary embodiment, the first end side 24 on which the channel 26 opens is the upstream end side. However, the first end side 24 on which the channel 26 opens can also be the downstream end side of the base body 23.

Figure 2:
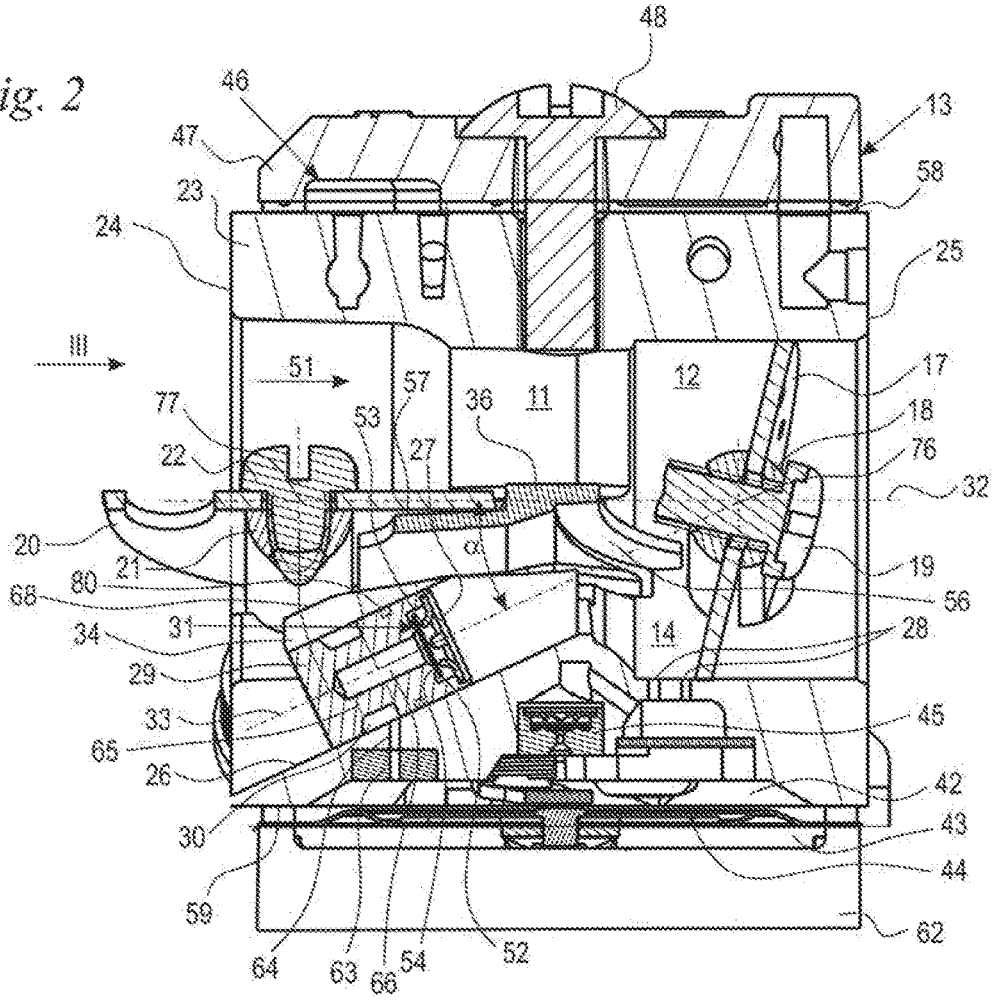
FIG. 2 shows a sectional illustration of one exemplary embodiment of a carburetor.

The main fuel nozzle 29 may advantageously be pressed into the channel 26. Here, the main fuel nozzle 29 can be pressed directly into the channel 26, with the result that the outside circumference of the main fuel nozzle 29 is in contact with the wall of the channel 26. Alternatively, the main fuel nozzle 29 can be pressed into the channel 26 with the interposition of at least one seal. For this purpose, FIG. 2 depicts a seal 80 schematically with a dashed line. The seal 80 can be an O-ring, for example. A plurality of seals 80 can also be advantageous.

As FIG. 1 shows, no further elements for subdividing the intake channel section 11 into a mixture channel 12 and air channel 14 are provided upstream of the throttle element 17, nor is a choke element provided.

In the exemplary embodiment according to FIG. 1, the intake channel 10 is divided by a partition wall 35 into the mixture channel 12 and the air channel 14 downstream of the throttle element 17. On the side facing the throttle element 17, the partition wall 35 has a bearing surface 38 against which the throttle element 17 bears in the completely opened position. In a partially closed position of the throttle element 17, an opening via which fuel can pass into the region situated upstream of the air channel 14 is formed between the throttle shaft 18 and the bearing surface 38.

Figure 4:
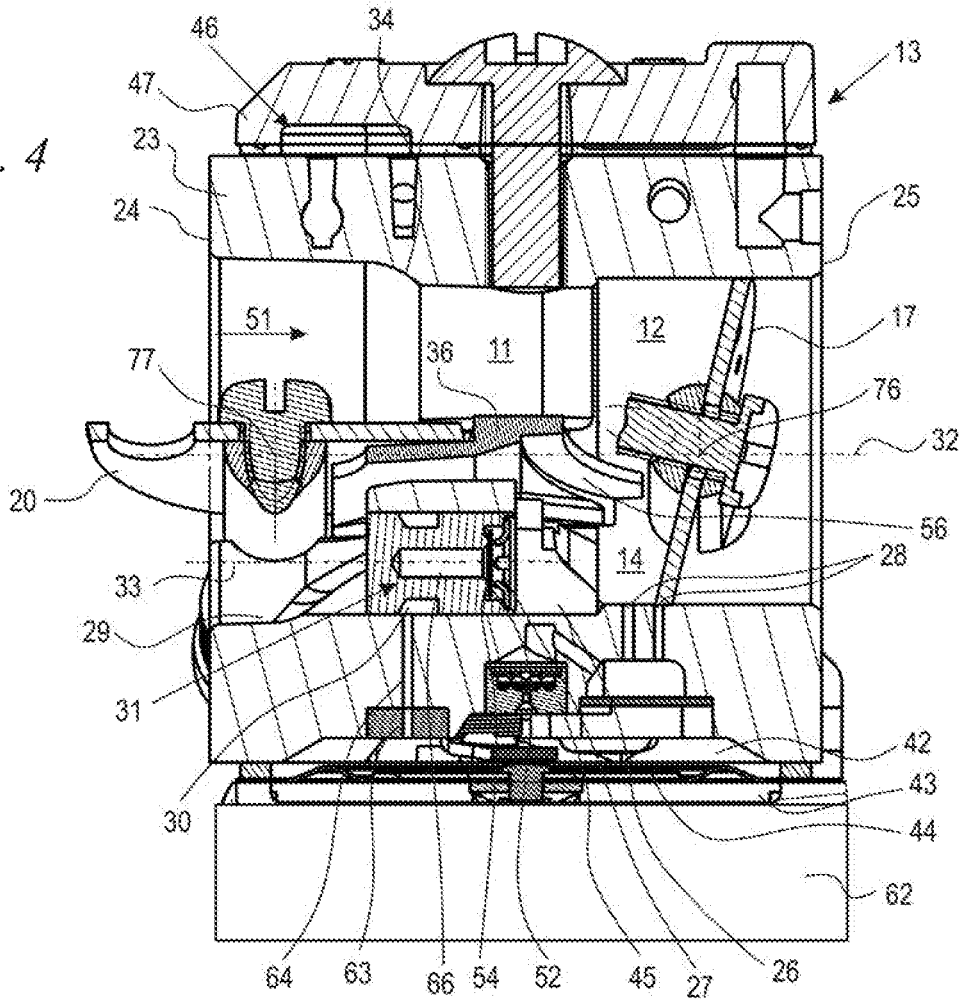
FIG. 4 shows a sectional illustration of a further exemplary embodiment of a carburetor; and, FIG. 5 shows a detail sectional illustration of a further exemplary embodiment of a carburetor.

During operation of the two stroke engine 1, fuel/air mixture is sucked from the mixture channel 12 into the crankcase interior 6 during the upward stroke of the piston 5 as soon as the mixture channel opening 15 opens. As long as the air channel opening 16 is connected to the transfer windows 9 via the piston pocket 37, scavenging advance air is provided upstream in the transfer channels 8. During the downward stroke of the piston 5, the air/fuel mixture in the crankcase interior 6 is compressed and, as soon as the transfer windows 9 open, scavenging advance air first of all flows out of the transfer channels 8 and then fuel/air mixture flows out of the crankcase interior 6 into the combustion chamber 3. The fuel/air mixture is compressed in the combustion chamber 3 during the upward stroke of the piston 5 and ignited by a spark plug 72 in the region of top dead center of the piston 5. Preferably, the spark plug 72 is activated by a control unit 61 which also activates a fuel valve 60 (FIG. 4). During the downward stroke of the piston 5, the piston 5 first of all opens the outlet 40, with the result that exhaust gases can flow out of the combustion chamber 3. The transfer windows 9 are then opened and scavenging advance air flows into the combustion chamber 3 and scavenges the remaining exhaust gases out of the combustion chamber 3 through the outlet 40. Fresh fuel/air mixture then flows into the combustion chamber 3 for the next combustion.

FIG. 2 shows a further exemplary embodiment of a mixture formation unit 13. In all exemplary embodiments, the same reference signs denote elements which correspond to one another. The mixture formation unit 13 from FIG. 2 likewise has a base body 23 with a first end side 24 and a second end side 25. During operation, air flows from the first end side 24 to the second end side 25, as is schematically illustrated by the arrow 51 in FIG. 2. The throttle element 17 is fixed to the throttle shaft 18 via a fastening screw 19. With respect to the flow direction, a choke element 20 is arranged in the intake channel section 11 upstream of the throttle element 17. The choke element 20 is configured as a choke flap and is fixed to a choke shaft 21 via a fastening screw 22. The throttle element 17 is mounted so as to be pivotable about a rotational axis 76, and the choke element 18 is mounted so as to be pivotable about a rotational axis 77. A partition wall section 36 is arranged in the intake channel section 11 in the flow direction between the choke shaft 21 and the throttle shaft 18. The partition wall section 36 separates the air channel 14 and mixture channel 12 from one another.

In the exemplary embodiment according to FIG. 2, a bearing surface 56 for the throttle element 17 is formed on the partition wall section 36. The bearing surface 56 is arranged on that side of the partition wall section 36 facing the mixture channel 12. A bearing surface 57 for the choke element 20 is formed on the side facing the air channel 14.

In the exemplary embodiment according to FIG. 2, too, a channel 26 is provided in the base body 23. The channel 26 can advantageously be configured as a rectilinear, continuous bore of constant diameter. The channel 26 may advantageously from the end side 24 up into the intake channel section 11. In the exemplary embodiment, the channel 26 is not closed over its entire length over its entire circumference, but is open in the region adjoining the end side 24 toward the intake channel section 11. There can also be provision that the channel 26 is configured to be circumferentially open over a subportion of its length in another direction. There can also be provision that the channel 26 is configured to be open over its entire length in one direction over a subportion of its circumference. Here, the wall delimiting the channel 26 can be configured to be for example approximately U-shaped in cross section. The channel 26 can be produced via drilling or milling or can be produced as a cast structure during the casting of the base body 23.

The channel 26 has a center axis 33. In the exemplary embodiment, the center axis 33 encloses an angle $\alpha$, which is less than 90°, with the intake channel longitudinal axis 32. In the exemplary embodiment, the angle $\alpha$ is greater than 0°. However, an angle of 0° can also be advantageous. The angle $\alpha$ is preferably from 0° to 30°, in particular from 0° to 25°. Here, the angle $\alpha$ is measured in a section plane which contains the intake channel longitudinal axis 32 and which extends parallel to the center axis 33 of the channel 26. In the exemplary embodiment, the section plane contains both the intake channel longitudinal axis 32 and the center axis 33 and corresponds to the section plane illustrated in FIG. 2. Should the intake channel longitudinal axis 32 and the center axis 33 extend obliquely to one another, the angle $\alpha$ is measured between the intake channel longitudinal axis 32 and a projection of the center axis 33 into the section plane in a projection direction perpendicular to the section plane.

The base body 23 of the mixture formation unit 13 has a first longitudinal side 58 and a second longitudinal side 59. The longitudinal sides 58 and 59 extend approximately parallel to the center axis 33 of the intake channel section 11. A fuel pump 46 can advantageously be formed on the first longitudinal side 58. The fuel pump 46 is delimited by the base body 23, by a pump cover 47 fixed to the base body 23 and also by a pump membrane (not shown). The pump cover 47 is preferably screwed to the base body 23 via a fastening screw 48. On the opposite longitudinal side 59, a regulating chamber 42 and a compensation chamber 43 which are separated by a control membrane 44 may advantageously be formed. The control membrane 44 is held on the base body 23 by a regulating chamber cover 62 schematically illustrated in FIG. 2. The regulating chamber 42 can advantageously be coupled in a customary manner by a spring-loaded lever to an inlet valve which controls the fuel flow from the fuel pump 46 into the regulating chamber 42. The regulating chamber 42 is connected to secondary fuel openings 28 via a check valve 45. Additionally leading out of the regulating chamber 42 is a fuel channel 64 in which a fixed throttle 63 is arranged in the exemplary embodiment. Instead of the fixed throttle 63, an adjustable throttle, for example, can be provided.

The main fuel nozzle 29 is arranged in the channel 26. On the outside circumference of the main fuel nozzle 29 there is formed an annular gap 30 into which the fuel channel 64 opens. The annular gap 30 is delimited by a peripheral groove on the outside circumference of the main fuel nozzle 29 and by the wall of the channel 26. In the main fuel nozzle 29 there is formed a transverse channel 65, which, in the exemplary embodiment, extends perpendicular to the center axis 33, and a longitudinal channel 66 which extends in the direction of the center axis 33 centrally through the main fuel nozzle 29. The annular gap 30 is connected to the longitudinal channel 66 via the transverse channel 65. The longitudinal channel 66 opens at a valve plate 52. The valve plate 52 forms with a valve seat 54 a check valve 31. In the closed state of the check valve 31, the valve plate 52 bears against the valve seat 54. In the case of excess pressure in the intake channel section 11 with respect to the regulating chamber 42, the check valve 31 is closed. In the case of negative pressure in the intake channel section 11, the valve plate 52 is lifted off the valve seat 54. The check valve 31 has a stop 53 which delimits the maximum stroke of the valve plate 52. The stroke of the valve plate 52 is preferably as small as possible.

Figure 3:
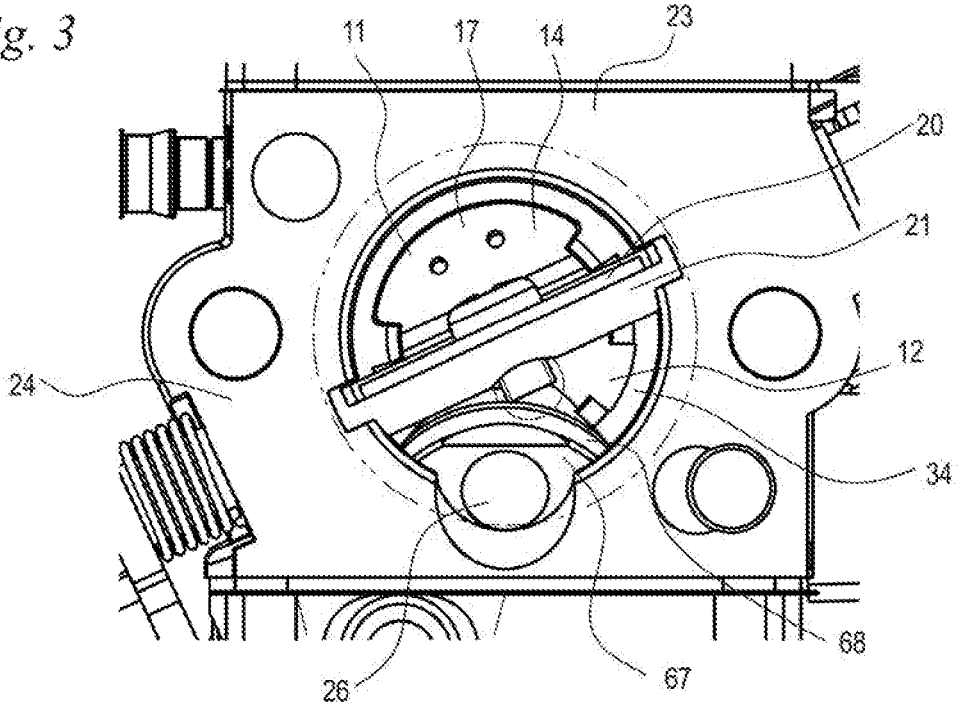
FIG. 3 shows a detail side view of the carburetor from FIG. 2 in the direction of the arrow III in FIG. 2.

FIG. 3 shows the mouth of the channel 26 on the first end side 24. In the exemplary embodiment, the channel 26 is formed completely in the base body 23 and configured to be at least partially closed over its circumference. For this purpose, the base body 23 has a section 67 which projects into the intake channel section 11. The section 67 reduces the free flow cross section in the mixture channel 12. In the exemplary embodiment, the section 67 has a bevel 68, with the result that the flow cross section increases at the section 67 in the direction of the arrow 51 (FIG. 2). The bevel 68 is also illustrated in FIG. 2. In an alternative embodiment, the bevel 68 can also be dispensed with. P FIG. 4 shows an exemplary embodiment of a mixture formation unit 13 whose construction substantially corresponds to the mixture formation unit 13 shown and described in FIGS. 2 and 3. The same reference signs denote elements corresponding to one another in all the figures. In the mixture formation unit 13 in FIG. 4, the channel 26 has been rotated with respect to the embodiment shown in FIGS. 1 and 2. The channel 26 extends parallel to the intake channel longitudinal axis 32. The center axis 33 of the channel 26 and the intake channel longitudinal axis 32 enclose an angle of 0°, and thus extend in parallel.

Figure 5:
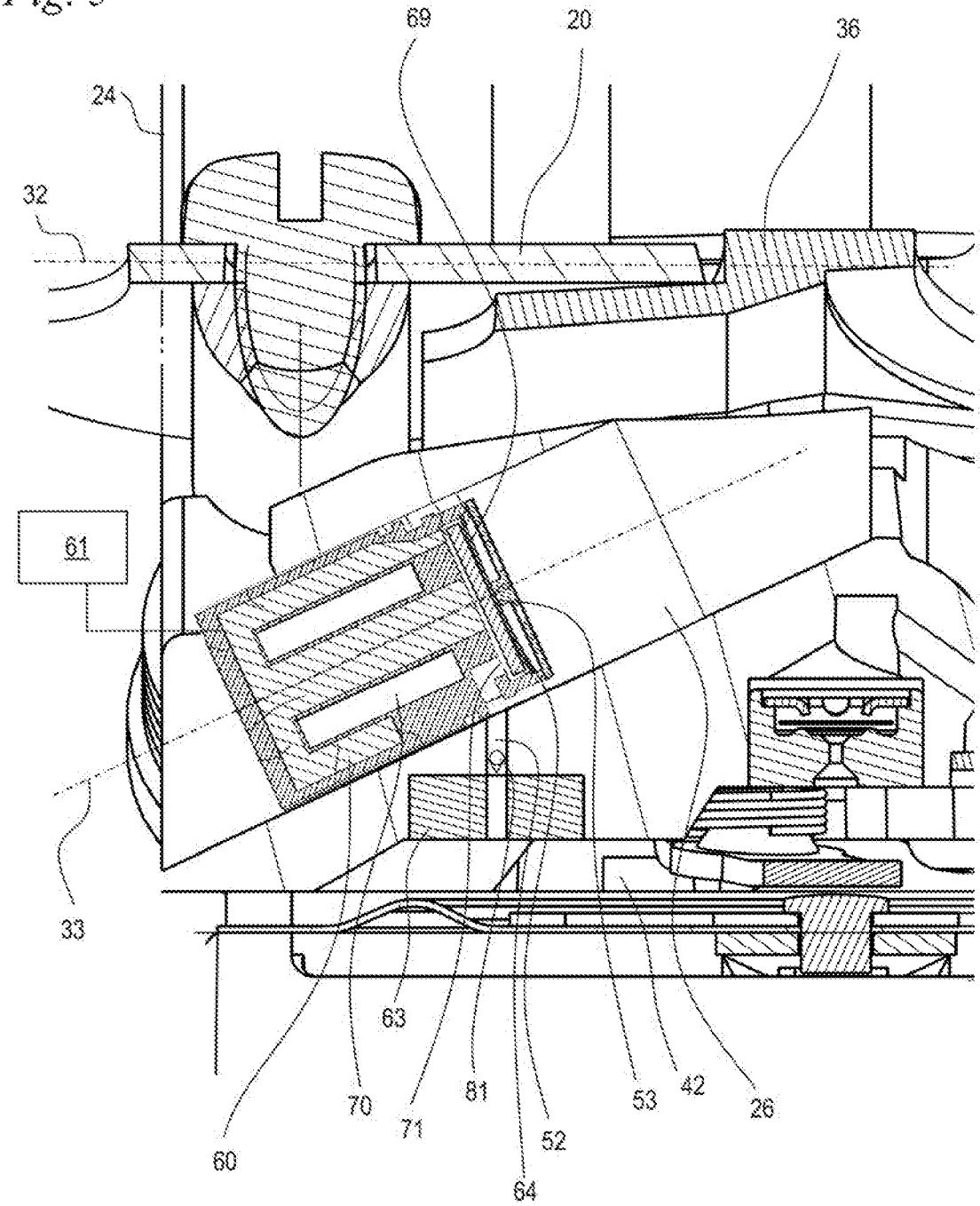

FIG. 5 shows an exemplary embodiment of a mixture formation unit 13 in which a fuel valve 60 is arranged in the channel 26. In terms of the further construction, the mixture formation unit 13 corresponds to the mixture formation unit 13 shown and described in FIGS. 2 and 3. The fuel valve 60 is an electromagnetic valve, preferably a valve which is open in the de-energized state. It can also be advantageous for the fuel valve 60 to be closed in the de-energized state. The fuel valve 60 likewise has a valve plate 52 which, however, is not acted upon by the prevailing pressure conditions, but rather by a spring 69 and an electromagnet 70. If current flows through the electromagnet 70, the valve plate 52 is drawn against an inlet opening 71 against the force of the spring 69 and closes the opening. In the de-energized state, the valve plate 52 is drawn toward a stop 53 and frees the inlet opening 71 in this position. To activate the electromagnet 70, the fuel valve 60 is connected to a control unit 61. The control unit 61 is in particular a control unit which also controls the ignition time of the two stroke engine 1 or of a four stroke engine.

In the exemplary embodiment, a check valve 81 is arranged in the fuel channel 64 which connects the regulating chamber 42 to the channel 26. The check valve 81 closes in the flow direction from the channel 26 to the regulating chamber 42. In the exemplary embodiment, the check valve 81 is arranged downstream of the fixed throttle 63. Another arrangement of the check valve 81 can also be advantageous.

Another configuration of the fuel valve 60 can also be advantageous. Instead of the main fuel nozzle 29 or the fuel valve 60, it is also possible for other components to be arranged in the channel 26. In the channel 26 there can be arranged in particular a needle valve or a spring-loaded valve, as is used for example in a purger.

In the exemplary embodiments, the mixture formation unit 13 is configured as a carburetor. A carburetor delivers the fuel into the intake channel as a result of the negative pressure existing in the intake channel. In an alternative configuration, another mixture formation unit can also be provided. The mixture formation unit can in particular have a fuel valve which supplies fuel into the intake channel as a result of excess pressure of the fuel, in particular injects the fuel into the intake channel.

It is understood that the foregoing description is that of the preferred embodiments of the invention and that various changes and modifications may be made thereto without departing from the spirit and scope of the invention as defined in the appended claims.

What is claimed is:

1. A mixture formation unit comprising:

a base body in which an intake channel section is formed;

said base body having a first end side and a second end side;

said intake channel section extending from said first end side of said base body to said second end side of said base body;

at least one rectilinearly extending channel which opens into the intake channel section; and, wherein said at least one rectilinearly extending channel and said intake channel section open at said first end side of said base body; and, wherein said intake channel section opens at said second end side of said base body.

2. The mixture formation unit of claim 1, wherein a component of the mixture formation unit is arranged in said at least one rectilinearly extending channel.

3. The mixture formation unit of claim 2, wherein said component arranged in said at least one rectilinearly extending channel is a fuel nozzle; and, said mixture formation unit has at least one fuel opening which opens into said intake channel section and which is formed on said fuel nozzle.

4. The mixture formation unit of claim 3, wherein said fuel opening is a main fuel opening and said fuel nozzle is a main fuel nozzle.

5. The mixture formation unit of claim 3, wherein said fuel nozzle and said at least one rectilinearly extending channel conjointly define an annular gap which is connected to said fuel opening.

6. The mixture formation unit of claim 2, wherein said component includes a check valve.

7. The mixture formation unit of claim 2, wherein said component is a fuel valve.

8. A mixture formation unit comprising:

a base body in which an intake channel section is formed;

said base body having a first end side and a second end side;

said intake channel section extending from said first end side of said base body to said second end side of said base body;

at least one rectilinearly extending channel which opens into the intake channel section;

wherein said at least one rectilinearly extending channel and said intake channel section open at said first end side of said base body;

wherein said intake channel section opens at said second end side of said base body;

wherein said at least one rectilinearly extending channel defines a center axis;

said intake channel section defines an intake channel longitudinal axis; and, said center axis encloses an angle ($\alpha$) of 0° to 30° with said intake channel longitudinal axis in a section plane which contains said intake channel longitudinal axis and which extends parallel to said center axis.

9. The mixture formation unit of claim 1 further comprising:

a throttle element;

said intake channel section having a venturi section; and, said throttle element being mounted in said base body downstream of said venturi section.

10. The mixture formation unit of claim 9, wherein said first end side of the base body is an upstream end side of the base body.

11. The mixture formation unit of claim 9, wherein said throttle element is a throttle flap.

12. The mixture formation unit of claim 11, further comprising a choke element held in the base body upstream of said throttle flap.

13. The mixture formation unit of claim 9, wherein no partition wall section is arranged in said intake channel section upstream of said throttle element.

14. The mixture formation unit of claim 9, wherein a partition wall section is arranged in said intake channel section upstream of said throttle element.

15. The mixture formation unit of claim 2, wherein said component is pressed into said at least one rectilinearly extending channel.

16. A two stroke engine comprising:

an intake channel having an intake channel section;

a mixture formation unit having a base body in which said intake channel section is formed;

said base body having a first end side and a second end side;

said intake channel section extending from said first end side of said base body to said second end side of said base body;

said mixture formation unit having at least one rectilinearly extending channel which opens into said intake channel section;

said at least one rectilinearly extending channel and said intake channel section opening at said first end side of said base body;

said intake channel section opening at said second end side of said base body;

a cylinder having a combustion chamber formed therein;

a crankcase defining a crankcase interior;

a crankshaft mounted in said crankcase;

a piston configured to drive said crankshaft;

said combustion chamber being delimited by said piston;

said crankcase interior being connected in at least one position of said piston to said combustion chamber via at least one transfer channel;

said intake channel being divided by a partition wall downstream of said intake channel section; and, said partition wall dividing said intake channel into a mixture channel for supplying a fuel/air mixture into said combustion chamber and into an air channel for supplying scavenging advance air to said at least one transfer channel.

17. The two stroke engine of claim 16, wherein no partition wall section is provided upstream of a throttle element for subdividing said intake channel section into said mixture channel and said air channel.

18. The two stroke engine of claim 16 further comprising:

a throttle element; and, said partition wall, upstream of said throttle element, includes a partition wall section for subdividing said intake channel section into a mixture channel and an air channel.

* * * * *